US009177446B2

(12) United States Patent
Byng

(10) Patent No.: US 9,177,446 B2
(45) Date of Patent: Nov. 3, 2015

(54) GAMING SYSTEM

(75) Inventor: Stephen Byng, New South Wales (AU)

(73) Assignee: ARISTOCRAT TECHNOLOGIES AUSTRALIA PTY LTD. (AU)

( * ) Notice: Subject to any disclaimer, the term of this patent is extended or adjusted under 35 U.S.C. 154(b) by 1892 days.

(21) Appl. No.: 10/824,028

(22) Filed: Apr. 13, 2004

(65) Prior Publication Data

US 2005/0003881 A1 Jan. 6, 2005

(30) Foreign Application Priority Data

Apr. 14, 2003 (AU) ..... 2003901769

(51) Int. Cl.
*G07F 17/32* (2006.01)

(52) U.S. Cl.
CPC ..... *G07F 17/3274* (2013.01); *G07F 17/3272* (2013.01)

(58) Field of Classification Search
CPC ... G07F 17/32; G07F 17/326; G07F 17/3272; G07F 17/3274; G07F 17/3276
USPC ..... 463/16–20, 25–26, 28–29, 42
See application file for complete search history.

(56) References Cited

U.S. PATENT DOCUMENTS

| | | | | |
|---|---|---|---|---|
| 5,564,700 | A | 10/1996 | Celona | |
| 6,077,162 | A | 6/2000 | Weiss | |
| 6,186,893 | B1 * | 2/2001 | Walker et al. | 463/20 |
| 6,206,782 | B1 | 3/2001 | Walker et al. | |
| 6,375,568 | B1 | 4/2002 | Roffman et al. | |
| 6,503,146 | B2 | 1/2003 | Walker et al. | |
| 6,648,753 | B1 | 11/2003 | Tracy et al. | |
| 6,692,354 | B2 | 2/2004 | Tracy et al. | |
| 2003/0064807 | A1 * | 4/2003 | Walker et al. | 463/42 |

* cited by examiner

*Primary Examiner* — Jasson Yoo
(74) *Attorney, Agent, or Firm* — McAndrews, Held & Malloy, Ltd.

(57) ABSTRACT

A gaming system includes a control unit. A plurality of gaming machines are linked to the control unit. An identifier is associated with one of each player and each gaming machine, the identifier providing an indication to the control unit whether or not the player wishes to participate in a cooperative gaming environment. The control unit monitors operation of the gaming machines in the cooperative gaming environment and, each time any one of a number of predetermined elements of the cooperative gaming environment changes, generating a milestone and using the milestone so that no one player in the cooperative gaming environment benefits at the expense of the other players participating in the cooperative gaming environment.

18 Claims, 5 Drawing Sheets

GAMING SYSTEM

PRIORITY INFORMATION

This application claims priority benefits of Australian Application No. 2003901769 filed Apr. 14, 2003 entitled, "Gaming System," the content of which is incorporated herein by reference.

FIELD OF THE INVENTION

This invention relates to a gaming system. More particularly, the invention relates to a gaming system and to a method of implementing cooperative gaming so as to encourage cooperative gaming amongst a group of players.

BACKGROUND TO THE INVENTION

Generally, in gaming machine play, each player plays individually in an attempt to win a prize. The prize could either be a progressive jackpot to which a number of gaming machines are linked or could be a prize on a stand-alone gaming machine.

When playing for a prize, each player plays on his or her own and it is an isolated experience. In addition, when playing to win a progressive jackpot prize players are, effectively, competing against each other for that prize. Should one of a number of players win the prize, the remaining players obtain no benefit and probably feel a degree of antagonism towards the prize winner.

Once a large progressive jackpot prize has been won there is less incentive for a group of players to play to win the jackpot prize when it is of a smaller amount knowing that, in all likelihood, the prize will increase with the passage of time. Thus, the operators of the venue in which the gaming machines are housed may lose out on turnover as a result of the reluctance of players to play the games.

In this specification, unless the context clearly indicates otherwise, the term "cooperative gaming" is to be understood as the cooperative interaction of two or more players of gaming machines with the object of sharing their experiences, risks and successes.

SUMMARY OF THE INVENTION

According to one aspect of the invention there is provided a gaming system which includes:

a control unit;

a plurality of gaming machines linked to the control unit;

an identifier associated with one of each player and each gaming machine, the identifier providing an indication to the control unit as to whether or not the player wishes to participate in a cooperative gaming environment; and the control unit monitoring operation of the gaming machines in the cooperative gaming environment and, each time any one of a number of predetermined elements of the cooperative gaming environment changes, generating a milestone and using the milestone so that no one player in the cooperative gaming environment benefits at the expense of the other players participating in the cooperative gaming environment.

According to another aspect of the invention, there is provided a gaming system which includes:

a control unit;

a plurality of gaming machines linked to the control unit;

an identifier associated with one of each player and each gaming machine, the identifier providing an indication to the control unit as to whether or not the player wishes to participate in a cooperative gaming environment; and the control unit providing the players participating in the cooperative gaming environment with the opportunity to adopt different strategies so that risk is distributed between the players participating in the cooperative gaming environment.

Players playing the gaming machines may be informed of the opportunity to participate in the cooperative gaming environment. The cooperative gaming environment may be initiated by one of the system and any one of the players, the players electing, at their option, whether or not to compete in the cooperative gaming environment. Should the players elect not to compete in the cooperative gaming environment, those players can continue to play standard one on one player versus system games.

The control unit may include a registration module for registering players that accept to participate in the cooperative gaming environment. The control unit may identify locations that will form part of the cooperative gaming environment, allow the players to nominate how much they wish to invest and determine whether or not there are sufficient players to constitute a cooperative gaming environment. It will be appreciated that there must be at least two players to form a cooperative gaming environment.

Further, the control unit may include a rules-establishing module for establishing the rules of the cooperative gaming environment, the rules determining general operating conditions of the cooperative gaming environment. The rules-establishing module may rely at least in part on player input in establishing the rules.

The rules may include whether or not new players may join the cooperative gaming environment, what happens when someone wishes to leave the cooperative gaming environment, whether the players all play the one game or if resources are to be pooled, whether the players are to play the same strategy or to choose their own strategy, whether players are able to determine their own investment or invest the same amount, whether wins are transferred to a credit pool of each player or are stored and distributed at the end of a cooperative gaming session or any other special criteria such as, for example, that the cooperative gaming session ends if the group reaches a financial goal (eg. doubling their money) or after the passage of a certain period of time.

The system may include a display so that, once the rules have been established, they are displayed to the players. The display may be a discrete display or may be a display associated with each gaming machine.

The players may then be offered a further opportunity to elect whether or not to continue in the cooperative gaming environment. Those that do not may be returned to conventional game play.

Where the players elect the rules and/or strategies to be adopted in the cooperative gaming environment, one of the rules may relate to how disputes are to be resolved. The first decision may attempt to gain a consensus as to how subsequent differences in selection are to be ratified.

In the sharing of risk, it will be appreciated that some players may play safer games which possess lower standard deviation or volatility while other players may play more risky games having higher standard deviation or volatility hence allowing the group to distribute the risk.

The control unit may include an allocating module for allocating a mixture of higher volatility and lower volatility games to the players participating in the cooperative gaming environment so that there is an even distribution of gaming machine volatility in the cooperative gaming environment.

Instead, the control unit may provide the players participating in the cooperative gaming environment with the opportunity to adopt different strategies so that risk is distributed between the players participating in the cooperative gaming environment.

During the course of play in the cooperative gaming environment, the control unit may allow existing players to exit and new players to enter the cooperative gaming environment in certain circumstances. It is in these circumstances that individual players must not be allowed to benefit unfairly from the effort of the group of players constituting the cooperative gaming environment.

The control unit may include a generating module for generating the milestones, the generating module, when a milestone needs to be generated, allowing all games in progress to be completed and then record the status of credit meters of all participating gaming machines and the current amount won at each of the participating gaming machines, the generating module of the control unit determining a final amount distributed to each player for each of the phases between milestones.

The predetermined elements of the cooperative gaming environment which are subject to change and which lead to the generation of milestones may include the total number of players either increasing or decreasing, the total amount of stake risked or when any single player's credits are depleted, i.e. reduced to zero.

When a new player joins an existing cooperative gaming environment, the generating module may generate a milestone and may record a current accumulated contribution by the players participating prior to the new player joining and a current amount won by those players. Fairness dictates that any new playing joining must not be able to access any winnings accumulated by previous game plays as the new player had no contribution or risk. Thus, at the end of a cooperative gaming session, the credit contributed by the new player may be weighed against the current credit total for future proportion of final wins.

Should a player wish to leave the cooperative gaming environment prior to the end of a session, such a player may only do so when the environment is idle, i.e. in between games. Since players may be interacting with the control unit asynchronously, the idle time may be defined for each player. This means that when the player is in between games then the cooperative gaming environment is idle for that player and that player may then choose to exit. At that time the control unit may resolve and display all existing games for all the other players and then proceed to allocate the current prize pool accordingly. When any single player leaves, the control unit may offer all the remaining players the opportunity to leave.

It will be appreciated that, when any player leaves, residual credits may be unallocated. The rules may govern that existing players leave unallocated residual credits in the gaming pool or that payment of the residual credits be resolved by an appropriate strategy.

According to a further aspect of the invention, there is provided a method of implementing cooperative gaming which includes:

monitoring a plurality of gaming machines linked to a control unit;

offering players playing those gaming machines an opportunity to compete in a cooperative gaming environment; and monitoring the cooperative gaming environment and, when any one of a number of predetermined elements of the cooperative gaming environment changes, generating a milestone and using the milestone so that no one player in the cooperative gaming environment benefits at the expense of the other players participating in the cooperative gaming environment.

According to yet a further aspect of the invention, there is provided a method of implementing cooperative gaming, the method including the steps of:

maintaining a plurality of gaming machines linked to a control unit;

offering players playing those gaming machines an opportunity to compete in a cooperative gaming environment; and allowing the players electing to participate in the cooperative gaming environment to adopt different gaming strategies so that risk is distributed amongst the players in the cooperative gaming environment.

The method may include informing the players playing the gaming machines of the opportunity to participate in the cooperative gaming environment. The method may include initiating the cooperative gaming environment by one of the system and any one of the players, the players electing, at their option, whether or not to compete in the cooperative gaming environment.

Further, the method may include registering players that do accept to participate in the cooperative gaming environment.

The method may include identifying locations that will form part of the cooperative gaming environment, allowing the players to nominate how much they wish to invest and determining whether or not there are sufficient players to constitute a cooperative gaming environment.

In addition, the method may includes establishing rules of the cooperative gaming environment, the rules determining general operating conditions of the cooperative gaming environment. It is to be noted that the method may include relying at least in part on player input in establishing the rules. The rules may include establishing whether or not new players may join the cooperative gaming environment, what happens when someone wishes to leave the cooperative gaming environment, whether the players all play the one game or if resources are to be pooled, whether the players are to play the same strategy or to choose their own strategy, whether players are able determine their own investment or invest the same amount, whether wins are transferred to a credit pool of each player or are stored and distributed at the end of a cooperative gaming session or any other special criteria such as, for example, that the cooperative gaming session ends if the group reaches a financial goal (eg. doubling their money) or after the passage of a certain period of time.

Once the rules have been established, the method may include displaying the rules to the players. Then, the method may include offering the players a further opportunity to elect whether or not to continue in the cooperative gaming environment. Those that do not may be returned to conventional game play.

The method may include establishing how disputes are to be resolved.

Further, the method may include allocating a mixture of higher volatility and lower volatility games to the players participating in the cooperative gaming environment so that there is an even distribution of gaming machine volatility in the cooperative gaming environment.

Instead, the method may include providing the players participating in the cooperative gaming environment with the opportunity to adopt different strategies so that risk is distributed between the players participating in the cooperative gaming environment.

The method may include, during the course of play in the cooperative gaming environment, allowing existing players to exit and new players to enter the cooperative gaming environment in certain circumstances.

When a milestone needs to be generated, the method may include allowing all games in progress to be completed and then recording the status of credit meters of all participating gaming machines and the current amount won at each of the participating gaming machines and determining a final amount distributed to each player for each of the phases between milestones.

The predetermined elements of the cooperative gaming environment which are subject to change and which lead to the generation of milestones may include the total number of players either increasing or decreasing, the total amount of stake risked or when any single player's credits are depleted.

When a new player joins an existing cooperative gaming environment, the method may include generating a milestone and recording a current accumulated contribution by the players participating prior to the new player joining and a current amount won by those players. At the end of a cooperative gaming session, the method may include weighing credit contributed by the new player against a current credit total for future proportion of final wins.

Should a player wish to leave the cooperative gaming environment prior to the end of a session, the method may include allowing the player to do so only when the cooperative gaming environment is idle. The method may therefore include when the player wishes to leave the cooperative gaming environment resolving and displaying all existing games for all the other players and then allocating a current prize pool accordingly. Further, the method may include, when any one player leaves, offering all the remaining players the opportunity to leave.

The method may include, when the player leaves, leaving unallocated residual credits in a remaining prize pool or, instead, resolving payment of unallocated residual credits by a preselected strategy.

BRIEF DESCRIPTION OF THE DRAWINGS

The invention is now described by way of example with reference to the accompanying diagrammatic drawings in which.

DETAILED DESCRIPTION OF THE DRAWINGS

Figure 1:
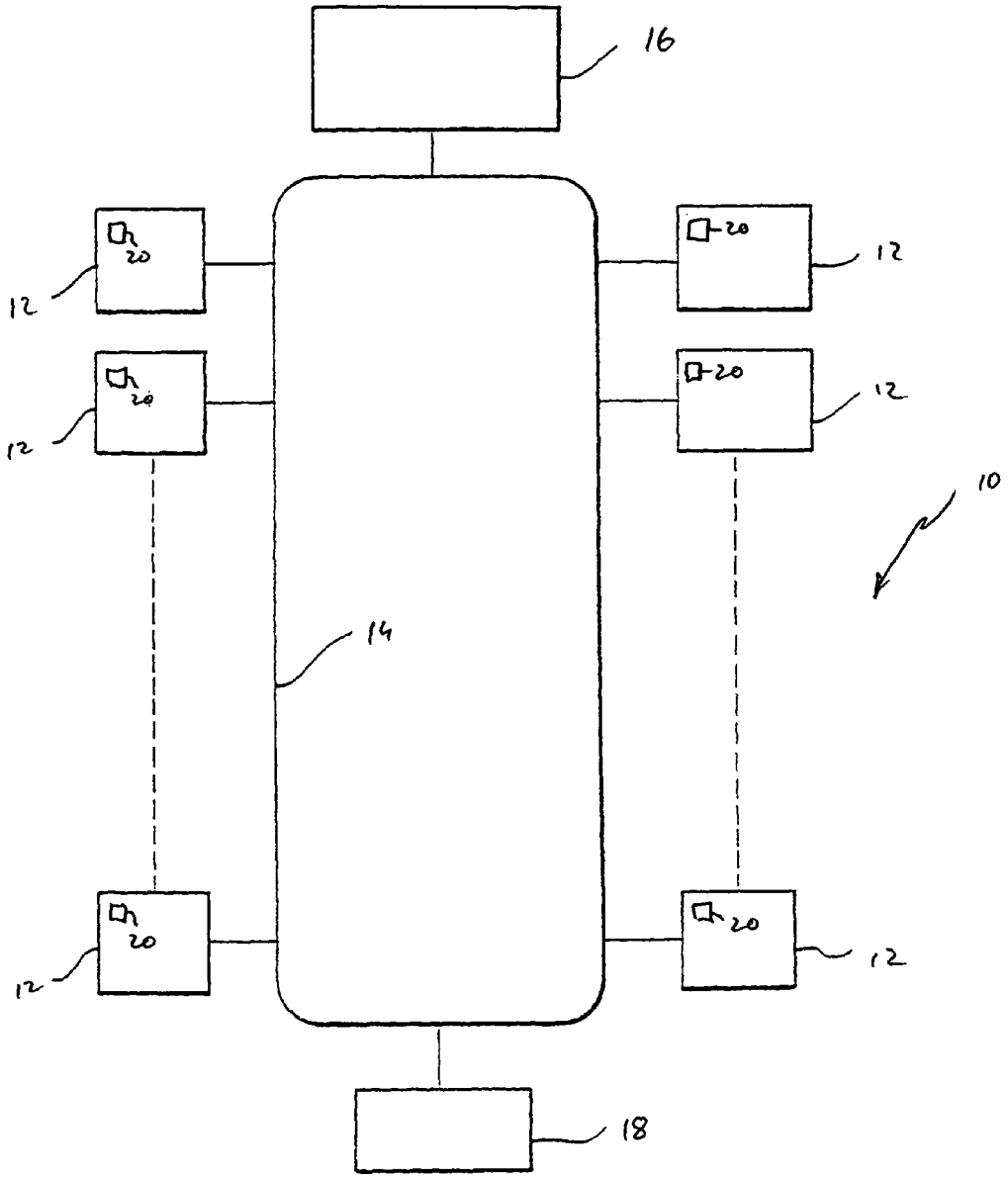
FIG. 1 shows a block diagram of a gaming system in accordance with the invention.

In the drawings, reference numeral 10 generally designates a gaming system in accordance with the invention. The gaming system 10 is intended particularly for use in encouraging cooperative gaming. The system 10 comprises a plurality of gaming machines 12 linked, via a network 14, to a central control unit 16.

While the network 14 is shown as a wired network, it will be appreciated that the network could include wireless components and that, further, the gaming machines 12 need not all be in the same venue.

Typically, in the playing of gaming machines 12 in a cooperative gaming environment, the players would be playing for a prize as designated generally at 18. The prize 18 could either be a linked progressive jackpot or it could be a prize on one of the linked gaming machines 12.

The system 10 includes an identification device 20 associated with each player and by means of which the player can indicate whether or not the player wishes to participate in the cooperative gaming environment. For example, the identification device could be an identification card, such as a customer loyalty card, which is inserted into a card reader (not shown) associated with each gaming machine 12. When a cooperative gaming environment is being established and the control unit 16 detects a card in the card reader the player can be polled by way of an appropriate message on a display of the gaming machine 12 as to whether or not the player wishes to participate in the cooperative gaming environment. Instead, of the player being identified to the system 10, the gaming machine 12 is identified so that anonymous game play can be effected.

Another way in which players can be invited to join the cooperative gaming environment is to register their interest with a software implemented registration module of the central control unit 16 so that, when a cooperative gaming environment presents itself, the players are invited to participate.

Figure 2:
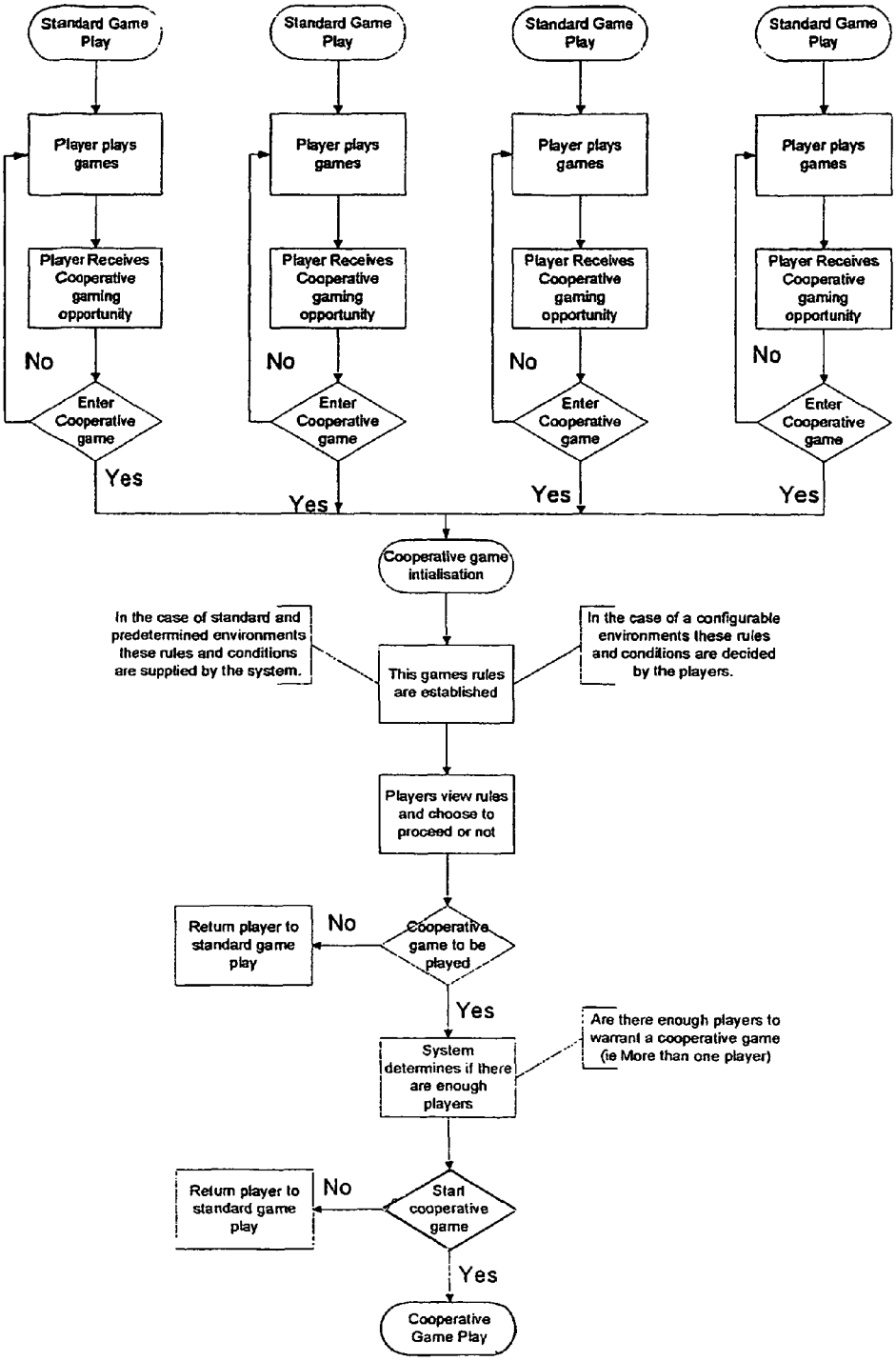
FIG. 2 shows a flow chart of an initial phase of entry into a cooperative gaming environment played on the system of FIG. 1.

FIG. 2 shows the general operation of entry into the cooperative gaming environment. Players are informed, while connected to the system 10, of the opportunity to participate in a cooperative gaming environment. Each player has the choice as to whether or not to join the environment. Those players that do not wish to join continue to play standard one on one player versus system games.

Any player who elects to join the cooperative gaming environment is registered by the central control unit 16. The unit 16 identifies the gaming machines 12 which will participate in the cooperative gaming environment. The unit 16 also allows the players to nominate how much they wish to invest and determines whether or not there are sufficient players to constitute a cooperative gaming environment. It will be appreciated that for a cooperative game to be played there must be at least two participants.

Once all the players have registered for a cooperative gaming session in the cooperative gaming environment, the system 10 will establish rules for the session via a software implemented rules-establishing module of the central control unit 16. The rules may be established either with the input of the participating player or there may be a predefined cooperative gaming environment stored by the central control unit 16. Generally, the rules will determine the operating conditions for the cooperative gaming environment and could include rules as to whether or not new players may join, what happens when someone wishes to exit the cooperative gaming environment, whether all the players will play the one game or if it is merely a pooling of resources, whether the players wish to play the same strategy or choice there own strategy or whether the players determine their own investment or risk the same amount.

Once the rules have been established they are displayed to the players on the displays of their gaming machines 12. The players are allowed a chance to continue to participate in the cooperative gaming environment. Those that choose to depart are returned to normal game play. The system 10 then determines if there are still enough players to continue with the cooperative gaming environment and, if so, a cooperative gaming effort or session starts.

As indicated above, each player must wish to be notified of the cooperative gaming opportunity. Accordingly, players must have the ability to restrict notification of these opportunities such as, for example, by allowing the player to turn off the reception of such messages at their gaming machine 12 or by the requirement for the player to register as an interested player.

In any situation where the entry into the cooperative gaming environment is delayed, if one player's credit balance reaches zero, the system 10 must assume that the player on that device is a new player. The system therefore assumes that no one, on that device, has registered to be notified of a cooperative gaming opportunity and/or check if that player desires to be informed of the opportunity. In an environment where a player's preference is recorded, this may be one of the preferences recorded and can therefore occur through the system 10 without player interaction.

Once a group of players have decided to participate in the cooperative gaming environment, the general operating conditions of the cooperative gaming environment need to be established. The operating conditions can be defined by the system 10, an operator of the system 10 or by the players themselves. The following operating conditions need to be established:

- target (for example, game to be played or jackpot to be attacked);
- credit meter scenarios;
- the investment of the participating players (for example, bet in slots, pokers and Keno);
- the strategy of the group (for example, the number of lines in a slot machine, the number of cards in a poker game, the number of balls in a Keno game); and
- the total stake of each player for the duration of the cooperative game (for example, a lost limit).

Another configuration option for the cooperative gaming environment is a decision as to whether or not new players will be permitted during the playing of the cooperative game to enter the existing game. The choices would be the following:

- never allow any future entrants;
- vote on each future entrant;
- always allow future entrants; and
- only allow existing players to re-enter such as when the credit meter of that player reaches zero.

There are two basic starting points for the cooperative use of the initial stake of the players (the credit meter scenarios) in that either all of the players' starting stakes (credits) are pooled together or each player maintains a separate credit meter.

In the former case, the system 10 ensures that the credits withdrawn are within the limits of the credit pool. Players may either freely withdraw from the credit pool or agree on a set risk limit. A risk limit is the potential loss of credits due to investment and strategy options and is similar to a maximum bet limit.

In the latter case, where each player maintains a separate credit meter they will still nevertheless share in a common winning pool.

The variations on the method used to establish the operating conditions of the cooperative gaming environment are as follows:

Option 1: Standard Environment.

A standard cooperative gaming environment exists. This includes standard terminals, games, investments, strategies and starting stake. Participants must abide by the predefined rules. All players interacting with the associated gaming machines 12 are automatically regarded as participants.

Option 2: Predetermined Environment.

Players indicate their desire to participate in a cooperative gaming environment. When a cooperative gaming environment becomes available, the exact nature of the environment and preset governing rules are communicated to the players. Players have the option as to whether or not to participate. The system determines if the number of players electing to participate justifies a cooperative game.

Option 3: Configurable Environment.

Players elect to participate in a cooperative gaming environment and, once such an opportunity is offered, they must select the type of environment that will exist. The group is requested to select their preferred mode of gaming which includes the manner in which disputes are resolved and options are selected. Of the options available, either the most conservative option is always selected, or majority rules but the most conservative option is chosen in case of a tied vote or majority rules but the least conservative option is chosen in case of a tied vote, or the least conservative option is always selected. At the end of the process of selecting the environment, the players elect to continue in the cooperative gaming environment so determined. The system 10 then determines if the number of remaining players electing to participate justifies continuing with the cooperative gaming environment.

Figure 3:
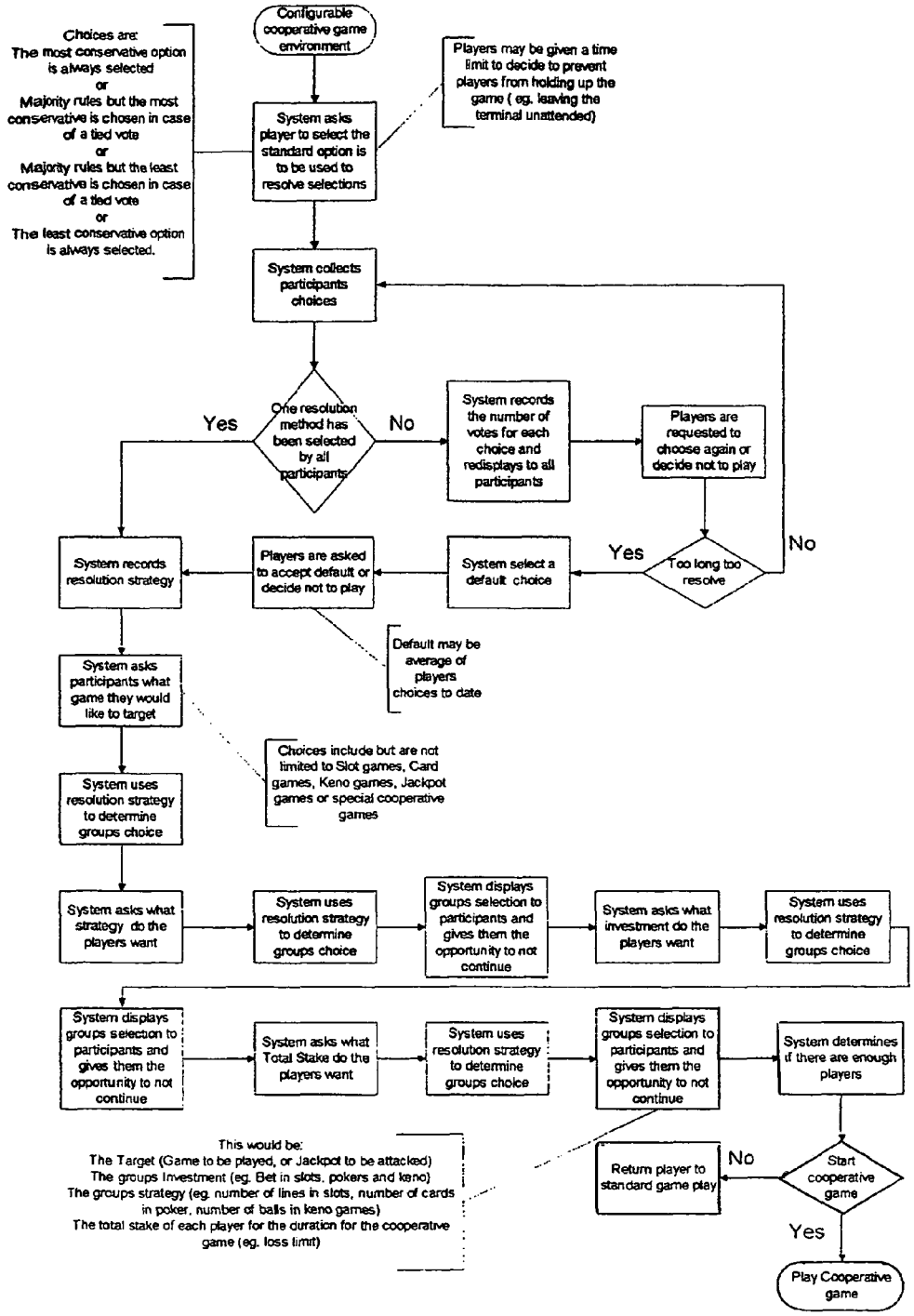
FIG. 3 shows a flow chart of group determination of the cooperative gaming environment.

The configurable environment is shown in FIG. 3 of the drawings. Importantly, the players' first decision is the manner in which disputes are to be resolved. Since the nature of the environment is cooperative, it is reasonable to believe that a consensus can be determined. The first decision therefore attempts to gain a consensus as to how all subsequent differences in selection are to be ratified. This allows subsequent decisions to be resolved efficiently. The options available are as set out above.

As each participant makes a choice, the central control unit 16 records the choice and the identity of the participants making the choice. If there is immediate consensus, the central control unit 16 proceeds. If not, the control unit 16 displays to all players the number of votes allocated to each choice. The players are then allowed to make anther choice or they can decide not to play. Any players deciding not to play are returned to standard game play and the remaining players make new choices until a consensus is reached.

In the event that a consensus cannot be reached, the central control unit 16 resorts to a default choice and asks the player to accept that choice or return to standard game play. The default choice may be predefined or the choice that had received the most votes by remaining players. At each stage, the central control unit 16 needs to determine if enough players remain to justify a cooperative gaming effort.

Once a resolution strategy has been selected, this is recorded by the central control unit 16. The process is repeated for each of the target game, the strategy, the investment and the total starting stake for the group. At each stage the system displays the choice and the players have the option to continue or to withdraw. It will be appreciated that, as players leave, the most popular resolution strategy may change. This might be communicated to the players to allow them to choose a new resolution strategy.

Once all selections have been determined, the resulting cooperative gaming environment is communicated to the players. The players are allowed a final opportunity to return to standard game play before the cooperative game effort begins.

Figure 4:
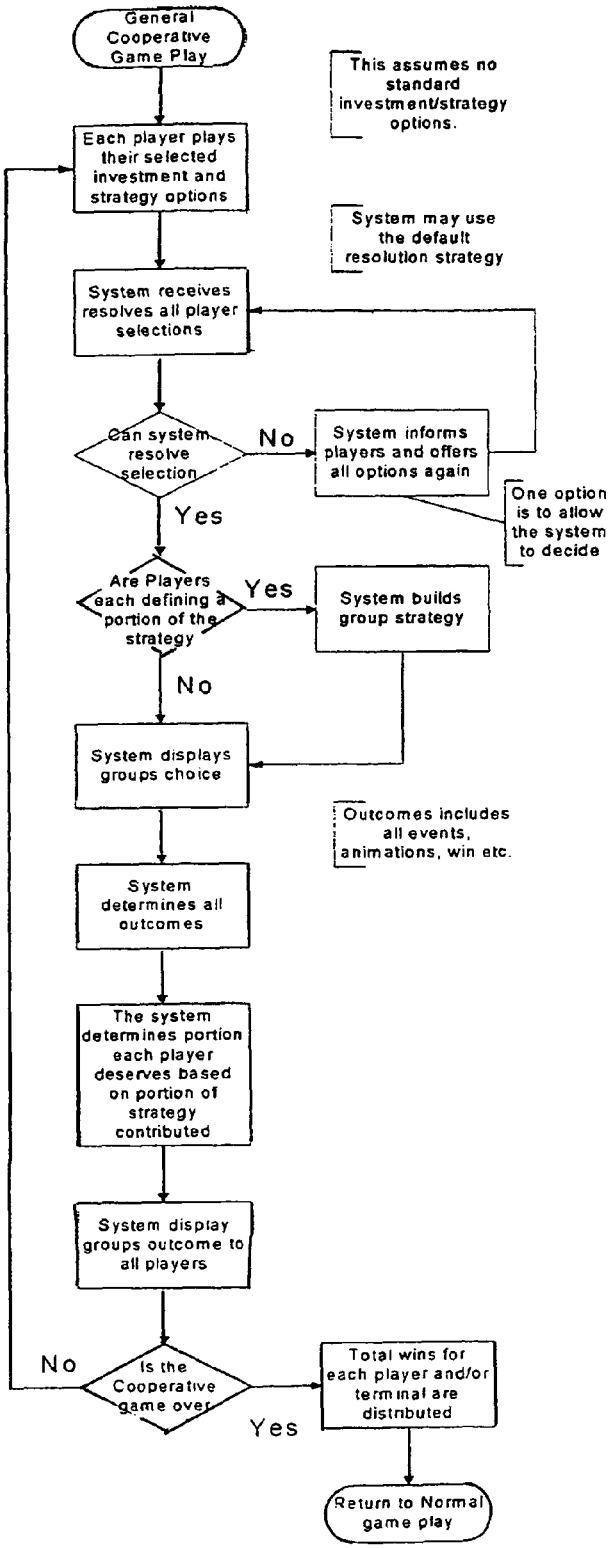
FIG. 4 shows a flow chart of cooperative game play.

One example of cooperative game play is shown in FIG. 4 of the drawings. The players have voted on the initial gaming strategy and investment. Games are then played until one of the participants desires to change strategy. The votes are recorded for each game to either stay with the existing game strategy and investment or to change. If the decision is to change, all players re-vote on the new strategy and investment. The system determines if the game may proceed based on the available stake, i.e. whether or not the player or the group have enough remaining stakes to cover the selections.

The central control unit 16 then monitors the input selection of the players, adjusts screens to reflect game, investment and strategy changes, adjusts the individual's or group's credits, determines all outcomes, displays the outcomes to the players and allocates all wins to the prize pool of the group.

In game play, there are scenarios where there is no obvious bias and situations may therefore arise where no clear choice can be resolved by the central control unit 16. This occurs, for example, when there is no further investment by the players and hence there is no most or least conservative choice. Examples include binary outcome scenarios, such as double-up, multiple selections for features or game choices. In case of a tie, the central control unit 16 communicates that the players' selections have resulted in a tied choice. The participants may then each select to choose another option or to allow the system to make a random choice for them. In each case, players are always provided with the opportunity to vote for all possible options.

In the case where players maintain their own credit pool, there are some special cooperative gaming opportunities possible. Since there are multiple credit pools, the maximum wager on the individual game may exceed the maximum permissible wager for an individual. However, any single player cannot exceed the maximum permissible wager. Each player can also make his or her own choice as to strategy. The total of all strategy selections is determined. This total is then used as a final combined strategy. For example, in the case of a cooperative gaming effort having three participants one player may select to play one line, a second player may select to play three lines and a third player may select to play five lines. The total number of lines are combined so that this results in nine lines being played.

Further, each credit that the group contributes may increase the possibilities of accessing new features. For example, each subsequent credit may buy an extra 'n' symbol positions, 'n' extra reels or 'n' extra winning combinations.

In general, if the number of players remaining is less than the minimum number to maintain a cooperative gaming environment then the cooperative gaming environment expires and players are paid appropriately. If the group no longer has sufficient credits to maintain their cooperative game play then the cooperative gaming environment also expires and the players are paid appropriately if any credits remain. The final total is paid to each participant according to the ratio of his or her original stake and on going contributions to wins.

Another cooperative game play scenario is possible where the players are allowed to participate in the environment while allowing freedom of choice. Players may select new choices of strategy, investment or games at any time. In this scenario some players may play safer games which possess lower standard deviation or volatility while other players may play more risky games having higher standard deviation and volatility. In this way, the group is allowed to distribute their risk. Play is very similar to standard game play but players share any wins with their fellow cooperative players. In other words, all wins are pooled.

Players pick a game or stay with their existing game. They may make this choice by communicating with fellow participants. Each player then chooses his or her investment option and strategy option and starts the game. Any or all of these choices may be made with input from the fellow participants. The central control unit 16 determines if the game may proceed based on the available stake to cover the selections made.

The central control unit 16 monitors the input selection of the players, adjusts the screens of the gaming machines 12 to reflect game, investment and strategy changes, adjusts the individual's or group's credits, determines all outcomes, displays the outcomes to the players and allocates all wins to the prize pool of the group.

Figure 5:
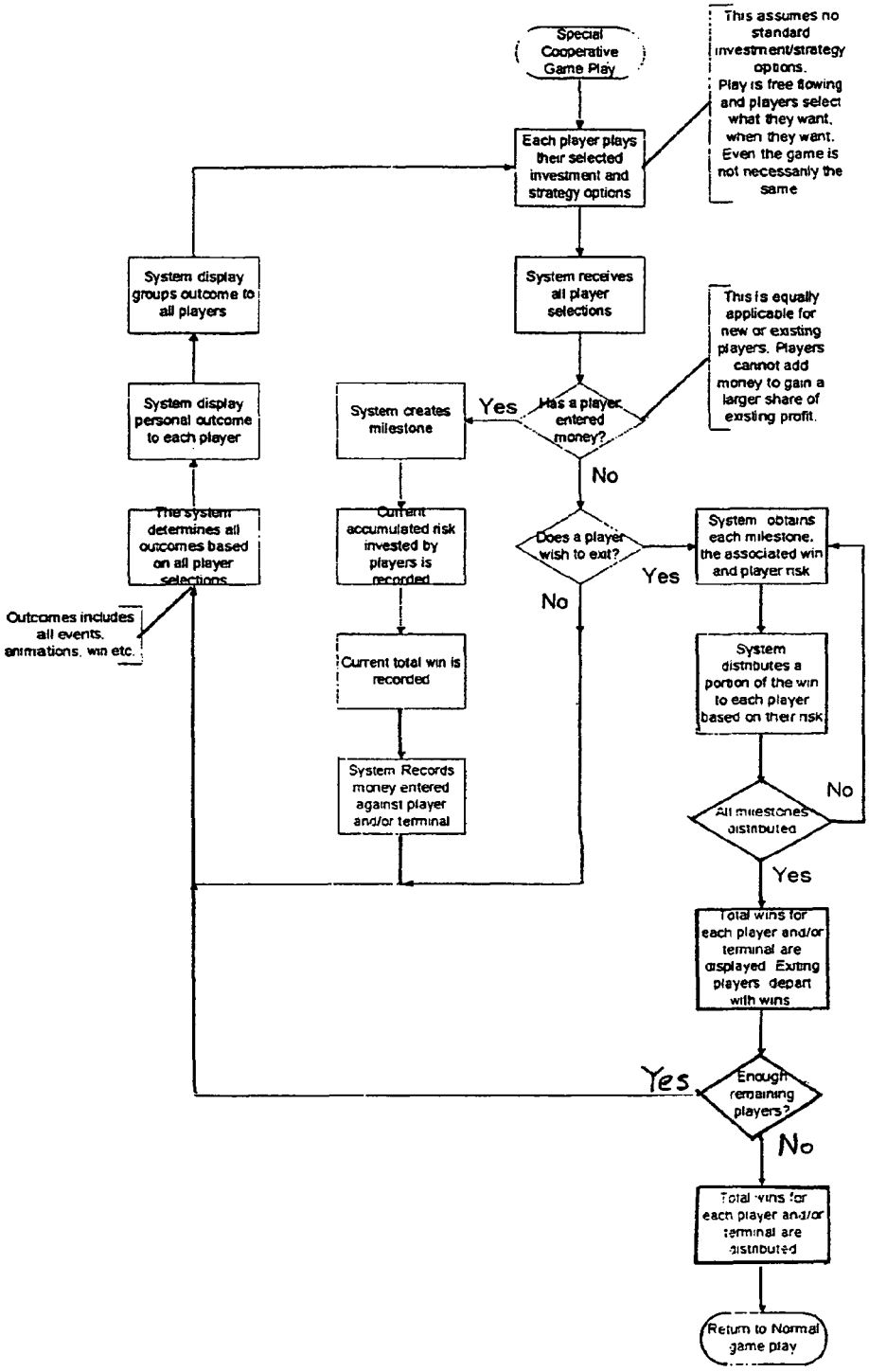
FIG. 5 shows a further flow chart of cooperative game play.

Referring now to FIG. 5 of the drawings, in this environment the central control unit 16 allows existing players to exit and, in certain circumstances, new players to enter. It is essential that one player cannot unfairly benefit from the effort of the group. For example, it is possible that wins are distributed according to the amount wagered by the participants. If a player were to notice that currently the group was in a winning situation it would then be unfair to allow that player to increase their amount risked and, in so doing, receive a larger portion of the win.

Similarly, should a player wish to exit, that player should be allowed to do so at the time of that player's choosing. A software implemented generating module of the control unit 16 therefore generates a milestone each time the basic elements of the cooperative gaming environment change. More particularly, the elements which are monitored by the control unit 16 are the total number of players (either increasing or decreasing) the total amount of stake risked (credits inserted) and when any single player reaches zero credits.

When the central control unit 16 needs to generate a milestone, it allows all games in progress to be completed and records the status of all credit meters and the current amount won. These are then used to determine the final amount distributed to each player for each of the phases between milestones. When a new player wishes to join the existing cooperative gaming environment, any players leaving that environment must first be resolved before permitting entry of the new player or players.

There are two methods of allowing a player to leave a cooperative gaming environment, being all players commit until credits are exhausted or players are allowed to exit at any time.

A player will be allowed to leave only in those situations where a player would be allowed a collect option. Any time is, of necessity, defined as only when the system 10 is idle, i.e. in between games or when an error has occurred preventing normal play. Since players may be interacting asynchronously with the system 10, the idle time of the system 10 is defined for each player. This means that when the player is in between games the system 10 is idle for that player. That player may then choose to leave the cooperative gaming environment. The system 10 resolves and displays all existing games for all the other players and proceeds to allocate the current prize pool accordingly. When any single player leaves the cooperative gaming environment, all players are offered the choice of terminating their participation.

There are two options available to resolve credits when a player exits. Players may either elect only to leave with available whole credits or players must resolve any disputed credits when any one player elects to leave the cooperative gaming environment.

Firstly, parts of the condition of entry may include that only whole credits are transferred to the participant leaving the cooperative gaming environment. When a player elects to leave the cooperative gaming environment, the current credit pool is subdivided according to the original portion of that player's contribution. The number of whole credits due to the departing player is subtracted from the total and is paid to that player. For example:

Five (5) players each initially contribute 100, 200, 300, 400 and 500 credits respectively for a total pool of 1500 credits. During the course of gambling the total pool reaches 3000 credits. Player two elects to no longer participate at which time Player two receives 400 credits and the balance (2600 credits) remain in the total pool.

If however, the total pool had reached 2999, then player two would only receive 399 credits and the pool is still 2600 credits.

Secondly, the players resolve any disputed credits when any one elects to exit. In this case, residual credits must be resolved through the unanimous decision that a single recipient receives the credits, the remaining players receive the credits or a rounding gamble is used to obtain an appropriate number of credits.

Using the preceding example where the pool is 2999 credits, the disputed credit is actually four credits because player 1 is owed 199 credits, player 2 is owed 399, player three is owed 599 credits, player 4 is owed 799 and player 5 is owed 999 credits. The total is therefore 2995 credits with a remainder of 4 credits. The departing player is offered the choice to leave the disputed credit with the group. If the player agrees to do so, the dispute is resolved. If the player disagrees, the remaining players are offered the choice to give the departing player the disputed credit. If the remaining players agree then the dispute is resolved. If the remaining players disagree or where authorities rule that agreeing to sacrifice credits is not within the best interests of players then a rounding gamble is made available. The outcome and selection of the rounding gamble is made according to the rules of the cooperative gaming environment.

Any player that desires to participate in an existing cooperative gaming environment must abide by the rules already present. When a player joins an existing cooperative gaming environment, the central control unit 16 generates a milestone and records the current accumulated contribution by the players already in the environment and the current amount won. The new player must not be able to access any winnings accumulated by previous plays as the new player had no contribution or risk. At the end of the cooperative game the credits contributed by the new player are weighed against the current credit total for a future proportion of final wins.

Example: Existing credits is 3000. New player joins with 100.

When determining future distribution of paid credits the portion due to the new player will by 100/3100 of the balance.

Final balance of 4500

Player 1=1/15*(4500*3000/3100), Player 2=2/15*(4500*3000/3100), Player 3=1/5*(4500*3000/3100), Player 4=4/15*(4500*3000/3100), Player 5=1/3*(4500*3000/3100) and the new player receives 100/3100 of 4500.

3 credits must be resolved according to the voted dispute decision criteria.

In an optimally managed cooperative gaming environment it may be feasible and is possibly the fairest option for the participating players to allow the system 10 randomly to determine the distribution of all options. The system 10 chooses an even distribution of highly volatile or less volatile games and allocates these to each participating player as well as defining the investment and strategy options. Thus, each player gets to play a variety of games and also uses a fair amount of the total stake risked while the whole group benefits from a managed gambling strategy.

It is therefore an advantage of the invention that a cooperative gaming environment is provided which allows players to distribute their risk. It also is flexible enough to allow players to enter and exit a cooperative gaming environment in a reasonably seamless manner without players in the cooperative gaming environment being prejudiced. Further, by allowing cooperative gaming, players can interact with each other thereby making the gaming experience more enjoyable.

It is also of benefit to the venue as, hopefully, cooperative gaming will encourage turnover on gaming machines operated by the venue.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A gaming system comprising:

a plurality of gaming machines; and a central control unit connected to said plurality of gaming machines; and i) wherein each of the plurality of gaming machines comprises at least one visual display device, a credit input mechanism configured to allow a player to insert credit, and a card reader configured to enable a player to provide a player identification, each of the gaming machines being configured to:

receive credit inserted by the player into the credit input mechanism;

determine a credit balance;

determine if the credit balance is a positive balance, and if the credit balance is positive, inform the player to participate in a cooperative game by joining in a cooperative gaming environment played by a plurality of players, contribute a portion of the credit balance as a wager amount to join the cooperative game in the cooperative gaming environment, and provide to the player an award from winnings obtained during the cooperative game; and ii) wherein the central control unit is configured to:

in response to at least one of said players joining the cooperative gaming environment, draw a consensus of at least one gaming option from said at least one of said players, in response to a consensus from said at least one of said players having been reached:

interact with said at least one of said players in order to present an invitation to allow a player to accept the invitation to join the cooperative gaming environment;

receive information from one or more gaming machines indicating an acceptance to join the cooperative gaming environment, the wager amount at each gaming machine, a change of said wager amount at each gaming machine, and a change of a number of gaming machines participating in the cooperative game of the cooperative gaming environment;

establish at least one rule for the cooperative game that can be played by the cooperative gaming environment after the receipt of information indicating said acceptance;

interact with the at least one visual display device of each of the gaming machines in order to present the at least one rule for the cooperative game to allow the player of the gaming machine to accept said at least one rule prior to commencing the cooperative game;

interact with each gaming machine in order to present an option to allow the player of the gaming machine to withdraw from the cooperative gaming environment prior to ending of gaming in the cooperative game as determined by the at least one rule, respond to the withdrawal of the player of the gaming machine from the cooperative gaming environment by allowing the cooperative games in progress to be completed and recording a status of all credit meters and a current amount won to determine a final amount that is to be distributed to each player, and distribute said current amount won based on a number of joined gaming machines and the current amount won, and in response to a consensus of at least one gaming option from said one or more players at said respective gaming machines not having been reached, resort to a default choice and ask said one or more players to accept said default choice or return to a standard game play.

2. The gaming system of claim 1, wherein the central control unit is further configured to:

determine whether there is at least a minimum number of players joined in the cooperative gaming environment; and allow the cooperative game to commence if it is determined that the minimum number of players have joined the cooperative gaming environment.

3. The gaming system of claim 1, wherein the central control unit is configured to establish the at least one rule, including configured to:

interact with the at least one visual display device in order to prompt the player to provide rule information; and establish the at least one rule based on the rule information.

4. The gaming system of claim 1, wherein the central control unit is configured to allow the player to specify how much the player wishes to contribute as the wager amount during play of the cooperative game.

5. The gaming system of claim 1, wherein the central control unit is further configured to establish the at least one rule after allowing the player to join.

6. The gaming system of claim 1, wherein the central control unit is further configured to allow a player to withdraw from the cooperative gaming environment after presenting the at least one rule.

7. The gaming system of claim 1, wherein the central control unit is further configured to allow changing the at least one rule.

8. The gaming system of claim 1, wherein the central control unit is further configured to present another rule during the cooperative game.

9. A gaming system comprising:

a control unit configured to control play of a cooperative game in a cooperative gaming environment;

a plurality of gaming machines linked to the control unit, each gaming machine having at least one visual display device, a credit input mechanism configured to allow a player to insert credit, and a card reader configured to enable a player to provide a player identification, each of the gaming machines being configured to:

determine a credit balance, in response to having a positive credit balance, inform the player to join in a cooperative game in a cooperative gaming environment, contribute a portion of the credit balance as a wager amount to join the cooperative game in the cooperative gaming environment; and wherein the control unit is further configured to:

increase at least one prize pool by win amounts resulting from individual cooperative games played by the gaming machine participating in the cooperative gaming environment, and in response to at least one of said players joining the cooperative game in the cooperative gaming environment, draw a consensus of at least one gaming option from said at least one of said players, and wherein the control unit is further configured:

i) in response to a consensus from said at least one of said players having been reached, during play of the cooperative game, (a) monitor gaming machine operation to determine a change to at least one of an amount wagered by any one of the gaming machines and a number of the gaming machines participating in said cooperative game in the cooperative gaming environment;

(b) in response to detecting an occurrence of the change, allow any individual games that were in progress at the time of the occurrence of the change to be completed prior to recording a credit meter status and win amount for each of the gaming machines since the last change; and (c) determine a prize pool distribution amount for each of the participating gaming machines based on the status and win amounts recorded for the respective gaming machines since joining the cooperative gaming environment in response to detecting the occurrence of the change, and ii) in response to a consensus from said at least one of said players not having been reached, resort to a default choice and ask said players to accept said default choice or return to a standard game play.

10. The system of claim 9, wherein the control unit is further configured to establish rules determining general operating conditions of the cooperative gaming environment.

11. The system of claim 10, wherein the control unit is further configured to rely at least in part, on player input in establishing the rules.

12. The system of claim 9, wherein the control unit is further configured to establish rules relating to requirements for new players entering the gaming environment and existing players exiting the cooperative gaming environment.

13. The system of claim 10, wherein the at least one visual display device is configured to display the established rules of the cooperative gaming environment.

14. The system of claim 9, wherein the control unit is further configured to allocate the individual games.

15. The system of claim 9, wherein the control unit is further configured to allocate a mixture of higher volatility and lower volatility individual games such that there is an even distribution of gaming machine volatility in the cooperative gaming environment.

16. The system of claim 9, wherein the control unit is further configured to allow players of the participating gaming machines to adopt different game play strategies so that risk is distributed between the players.

17. The system of claim 9, wherein the control unit is further configured to maintain a separate prize pool for each of the participating gaming machines.

18. The system of claim 17, wherein the control unit is further configured to carry out steps (b) and (c) in response to determining a zero credit balance for any one of the participating gaming machines.

* * * * *